US008505635B2

(12) United States Patent
Vatne

(10) Patent No.: US 8,505,635 B2
(45) Date of Patent: Aug. 13, 2013

(54) DEVICE FOR A TOP DRIVE DRILLING MACHINE FOR CONTINUOUS CIRCULATION OF DRILLING MUD

(76) Inventor: Per A. Vatne, Kristiansand (NO)

( * ) Notice: Subject to any disclaimer, the term of this patent is extended or adjusted under 35 U.S.C. 154(b) by 233 days.

(21) Appl. No.: 12/600,576

(22) PCT Filed: May 26, 2008

(86) PCT No.: PCT/NO2008/000182
§ 371 (c)(1),
(2), (4) Date: Apr. 20, 2010

(87) PCT Pub. No.: WO2008/147210
PCT Pub. Date: Dec. 4, 2008

(65) Prior Publication Data

US 2010/0200299 A1 Aug. 12, 2010

(30) Foreign Application Priority Data

May 30, 2007 (NO) ..... 20072761

(51) Int. Cl.
*E21B 19/18* (2006.01)
*E21B 21/12* (2006.01)

(52) U.S. Cl.
USPC ..... 166/379; 166/77.1; 166/86.2; 166/77.53; 175/218

(58) Field of Classification Search
USPC ..... 166/77.1, 77.53, 78.1, 86.2, 77.51, 166/379; 175/218; 81/57.15
See application file for complete search history.

(56) References Cited

U.S. PATENT DOCUMENTS

| | | | | |
|---|---|---|---|---|
| 6,688,394 | B1 | 2/2004 | Ayling | |
| 7,028,787 | B2 | 4/2006 | Allen et al. | |
| 7,107,875 | B2 | 9/2006 | Haugen et al. | |
| 8,033,338 | B2 * | 10/2011 | Springett | 166/386 |

(Continued)

FOREIGN PATENT DOCUMENTS

| | | |
|---|---|---|
| CA | 2550981 | 4/1998 |
| CA | 2514136 | 1/2006 |

(Continued)

OTHER PUBLICATIONS

European Patent Office, "Notification of Transmittal of Intl Search Report and Written Opinion," European Patent Office, (Jan. 28, 2009).

(Continued)

*Primary Examiner* — Nicole Coy
(74) *Attorney, Agent, or Firm* — Eubanks PLLC

(57) ABSTRACT

A device for a top drive drilling machine, in which a drive shaft (14), which is arranged for releasable connection to a drive (12) and to a first end portion (51) of a drill pipe (5), is provided with a center bore (141) extending therethrough and arranged for fluid communication between the drilling mud plant (6) and a fluid bore (53) in the drill pipe (5). First and second releasable, drive-shaft-surrounding, respectively drill-string-surrounding, pressure seals (1311*c*, 1321) and a valve (133) which is arranged to provide, in an open position, a passage (1331) for the drill pipe (5) or drive shaft (14), form a first and a second chamber. A drilling mud inlet (1323) is arranged for the second chamber (132) and is arranged for fluid communication between the drilling mud plant (6) and connection housing (13). A method for the continuous supply of drilling mud to a drill string (4) by the use of the drilling machine.

9 Claims, 7 Drawing Sheets

(56) References Cited

U.S. PATENT DOCUMENTS

| | | | | |
|---|---|---|---|---|
| 2003/0221519 | A1* | 12/2003 | Haugen | 81/57.15 |
| 2003/0234101 | A1 | 12/2003 | Ayling | |
| 2009/0025930 | A1* | 1/2009 | Iblings et al. | 166/244.1 |

FOREIGN PATENT DOCUMENTS

| | | |
|---|---|---|
| CA | 2588745 | 6/2006 |
| EP | 1507952 | 11/2003 |
| GB | 2399112 | 9/2004 |
| WO | WO 00/79092 | 12/2000 |
| WO | WO 01/69034 | 9/2001 |
| WO | WO 2007/064231 | 6/2007 |

OTHER PUBLICATIONS

European Patent Office, "Notification of Transmittal of International Preliminary Report on Patentability," European Patent Office, (Jul. 14, 2009).

Norway Patent Office, "Norwegian Search Report," Norway Patent Office.

* cited by examiner

DEVICE FOR A TOP DRIVE DRILLING MACHINE FOR CONTINUOUS CIRCULATION OF DRILLING MUD

CROSS-REFERENCE TO PENDING APPLICATIONS

This application is based on PCT Patent Application No. NO2008/000182, filed on May 26, 2008, which was based on Norwegian Patent Application No. 20072761, filed May 30, 2007.

The invention relates to a device for the continuous circulation of drilling mud by the use of a top drive drilling machine when drilling in the underground, in particular in exploration and production drilling for hydrocarbons. More particularly, the invention relates to a top drive drilling machine with a disconnectable drive shaft and optional lateral supply of drilling mud to a lower portion of the drilling machine for the circulation of drilling mud while an upper portion of the drilling machine is relieved of fluid pressure for the temporary removal of the drive shaft for the connection of a new pipe section to the drill string.

In drilling, drilling mud is used for, among other things, lubricating the drill bit and transporting cuttings out of the borehole. Typically, the drilling mud is pumped down the centre bore of the drill string and returned in the annulus between the drill string and the borehole wall/casing/riser. According to the prior art, when the drill string is to be extended by a new drill pipe section, the pumping of drilling mud must be stopped, as the supply line must be disconnected from the top of the drill string while the new pipe section is fitted. Such stopping of the drilling mud circulation creates a great risk that cuttings will settle, that is, sink in the static drilling mud, thereby blocking resumed drilling mud circulation and/or causing the drill string to get stuck. Repairing such faults is time-consuming, costly and subjects the equipment to great strain, as the methods used may involve, for example, a short, dramatic increase in the drilling mud pressure.

The invention has for its object to remedy or to reduce at least one of the drawbacks of the prior art.

The object is achieved through features which are specified in the description below and in the claims that follow.

The invention relates to a device for a top drive drilling machine, in which the circulation of drilling mud may run continuously and uninterruptedly, independently of whether drilling is in progress or whether there is a halt in the drilling operation because the drill string is to be extended by the addition of a new drill pipe section. The object is achieved by the drilling machine including a disconnectable drive shaft which is arranged to engage the drive of the drilling machine and a drill string extending through a central bore of the drilling machine. The drilling machine includes means for connecting pipes, snubbing and hanging off the drill string, and it is all surrounded by a pressure-tight, cylinder-shaped connection housing. The connection housing includes a lower drill-string-surrounding seal at a lower end portion, an upper drive-shaft-surrounding seal and an intermediate ball valve. Drilling mud supply is arranged through the drive shaft to the centre bore of the drill string section engaged by the drive shaft, and to a lower portion of the connection housing via a lateral supply bore. The supply through the lateral bore is used when the drive shaft has been disconnected from the drill string, the ball valve and the lower seal then isolating a lower connection housing portion, into which the centre bore of the drill string opens. Drilling mud supplied through the lateral bore to the lower connection housing portion will then flow into the drill string, and circulation of drilling mud is maintained also when the supply from the top of the drilling machine has to be stopped for a new pipe section to be connected.

In a first aspect the invention relates more specifically to a device for a top drive drilling machine with an associated drilling mud plant, characterized by the drilling machine including a drive shaft which is arranged for releasable connection to a drive and to a first end portion of a drill pipe and provided with a centre bore therethrough, which is arranged for fluid communication between the drilling mud plant and a fluid bore of the drill pipe;

a connection housing including a first chamber and a second chamber and a centre bore therethrough, the first chamber being provided with a releasable, drive-shaft-surrounding first pressure seal, the second chamber being provided with a releasable, drill-string-surrounding second pressure seal, and an interface between the first and second chambers being made up of a valve which is arranged to provide, in an open position, a passage for the drill pipe or drive shaft; and a drilling mud inlet arranged for the second chamber and arranged for fluid communication between the drilling mud plant and the connection housing.

The connection housing is advantageously provided with a thrust device arranged to move the drill pipe in the axial direction against a well pressure, for connection to the drill string.

Preferably, the valve is a ball valve.

Advantageously, the ball valve includes a seat portion which is arranged to receive an end portion of the drill pipe.

Preferably, the seat portion is formed on a valve ball surface.

A mechanical connection between the connection housing and the drill pipe is arranged by the thrust device which is provided with several actuators arranged for axial movement of the drill pipe and at least one set of gripping means which are arranged to enclose the drill pipe entirely or partially, one or more articulations arranged for the actuators being arranged to provide the axial movement when the first chamber is subjected to a fluid pressure.

Advantageously, the drive shaft includes a bearing portion which is arranged for releasable engagement with a rotatable power tong.

Preferably, the bearing portion has a polygonal cross-sectional profile.

In a second aspect the invention relates to a method of continuously supplying drilling mud by the use of a top drive drilling machine as it is described above, characterized by the method comprising the following steps:

a) establishing a borehole with a drill string and a circulation circuit for the drilling mud, a drive shaft arranged for the drilling machine being connected to the drilling mud plant and drill string, and the drilling mud being supplied to the borehole through a centre bore in the drive shaft arranged for fluid communication with the drill string;

b) activating a first pressure seal around the drive shaft in a first chamber of a connection housing, and forming a second pressure seal around the drill string in a second chamber of the connection housing;

c) supplying drilling mud to the second chamber through a drilling mud inlet;

d) stopping the drill string rotation and disconnecting the drive shaft from the drill string;

e) pulling the drive shaft out of the second chamber;

f) closing, in a pressure-sealing manner, a valve forming an interface between the first and second chambers;
g) stopping the supply of drilling mud through the drive shaft;
h) pulling the drive shaft out of the first chamber;
i) connecting a drill pipe to the drive shaft;
j) inserting the drill pipe and drive shaft into the upper chamber;
k) activating the first pressure seal;
l) opening the valve;
m) stopping the supply of drilling mud through the drilling mud inlet;
n) connecting the drill pipe to drill string;
o) resuming the drill string rotation; and
p) repeating the steps b-o whenever there is a need to extend the drill string.

In what follows, an example of a preferred embodiment is described, which is visualized in the accompanying drawings, in which.

Figure 3:
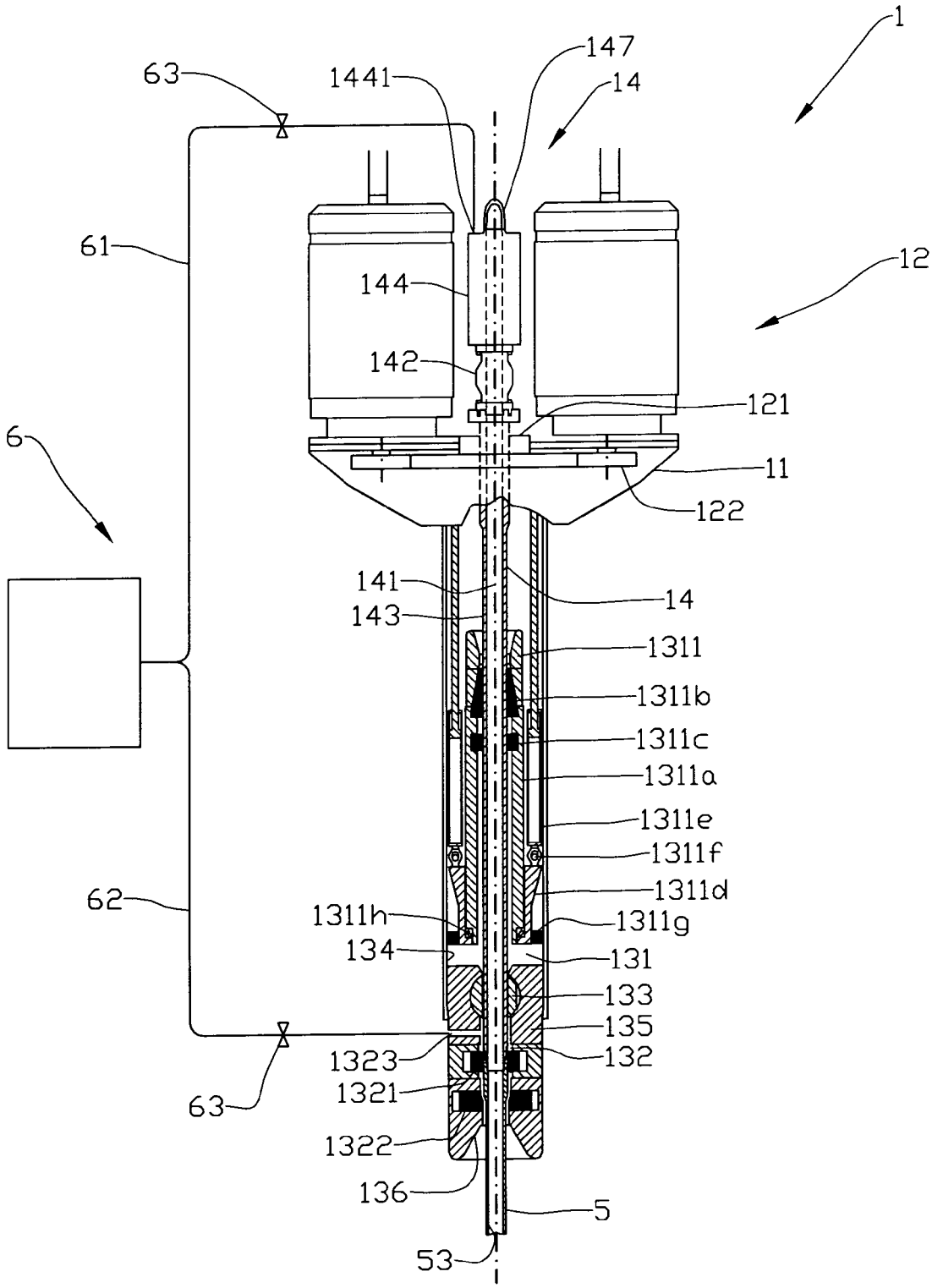
FIG. 3 shows a principle drawing in a partially cutaway side view, in which the drive shaft is connected to the drive and the drill string, the supply of drilling mud running through the drive shaft and the second pressure seal being activated.
Figure 4:
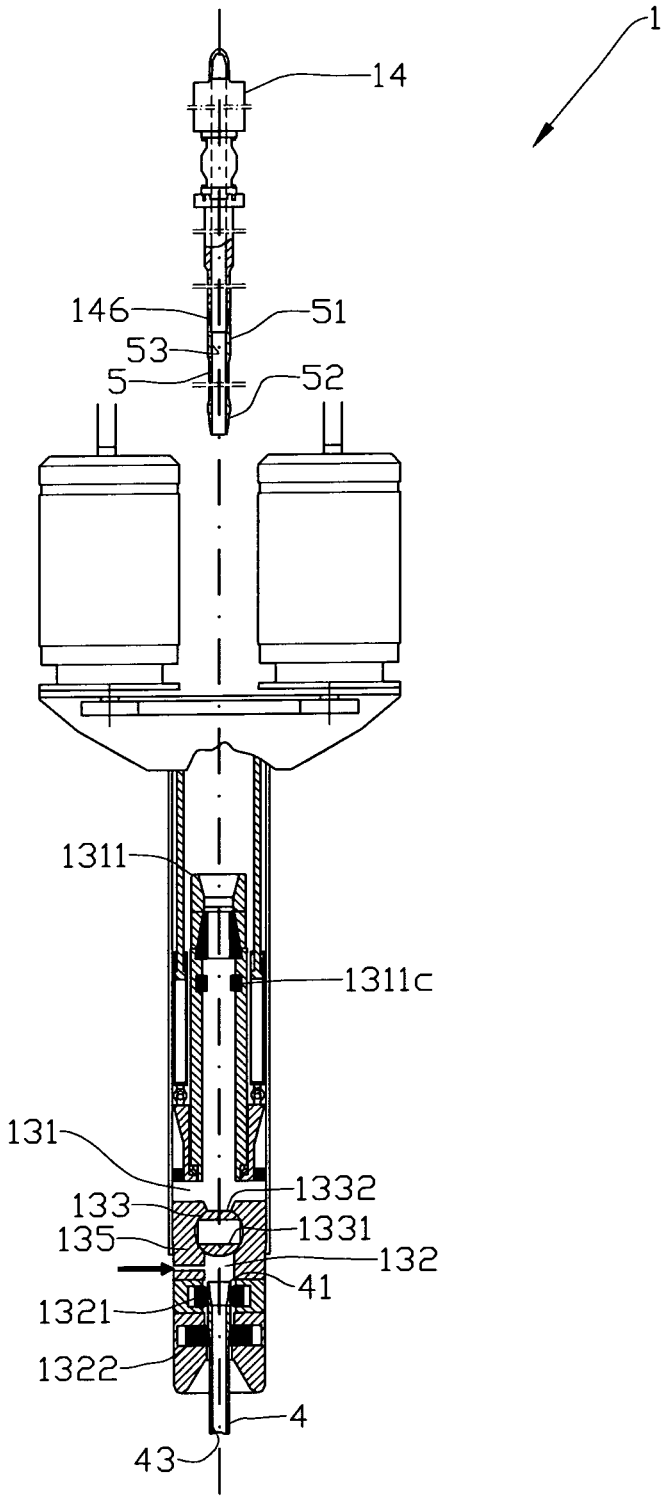
Figure 5:
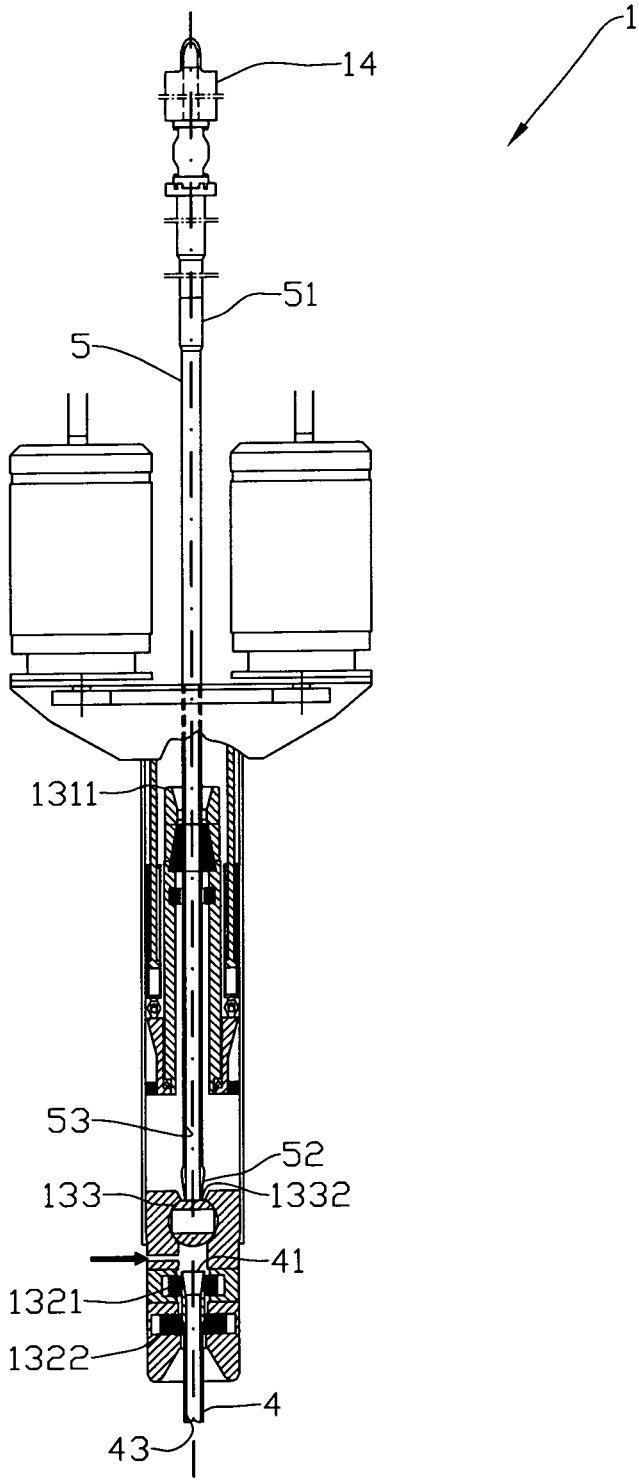
Figure 6:
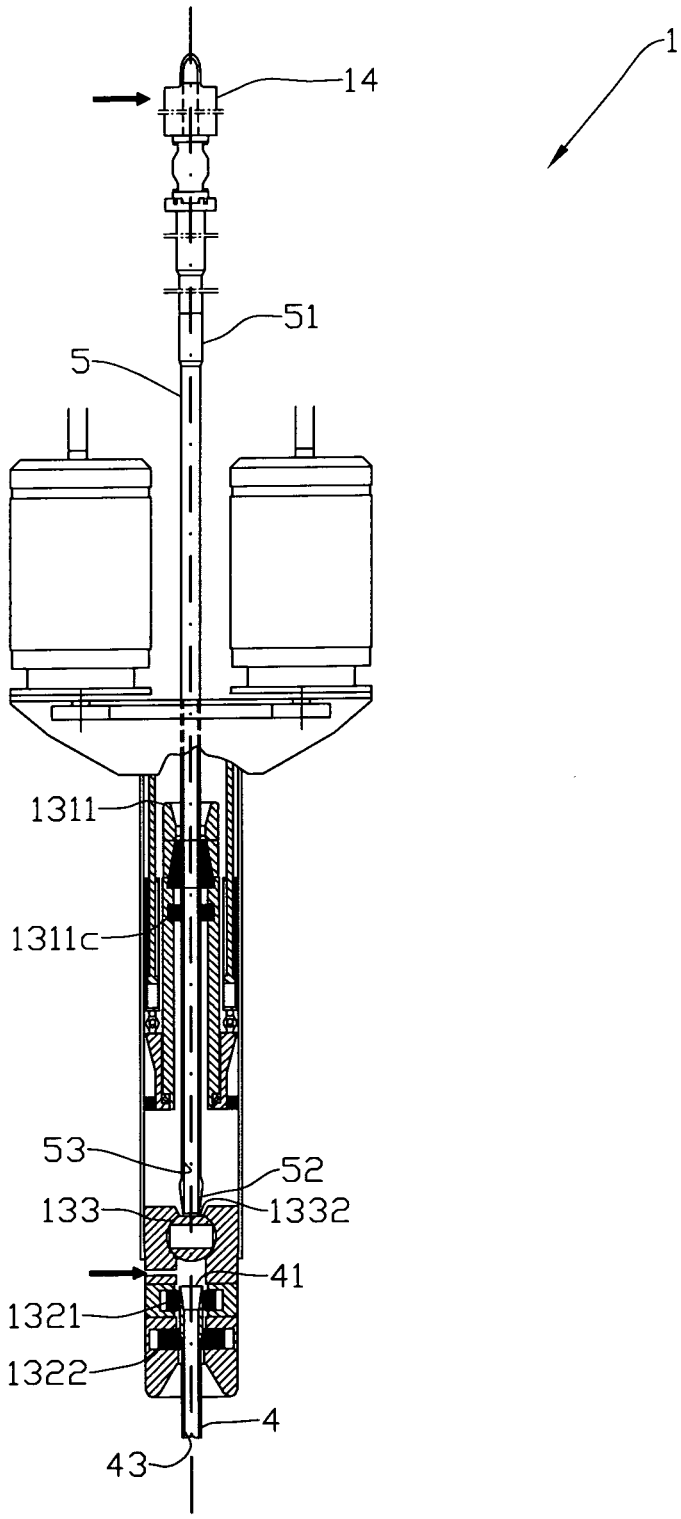
Figure 7:
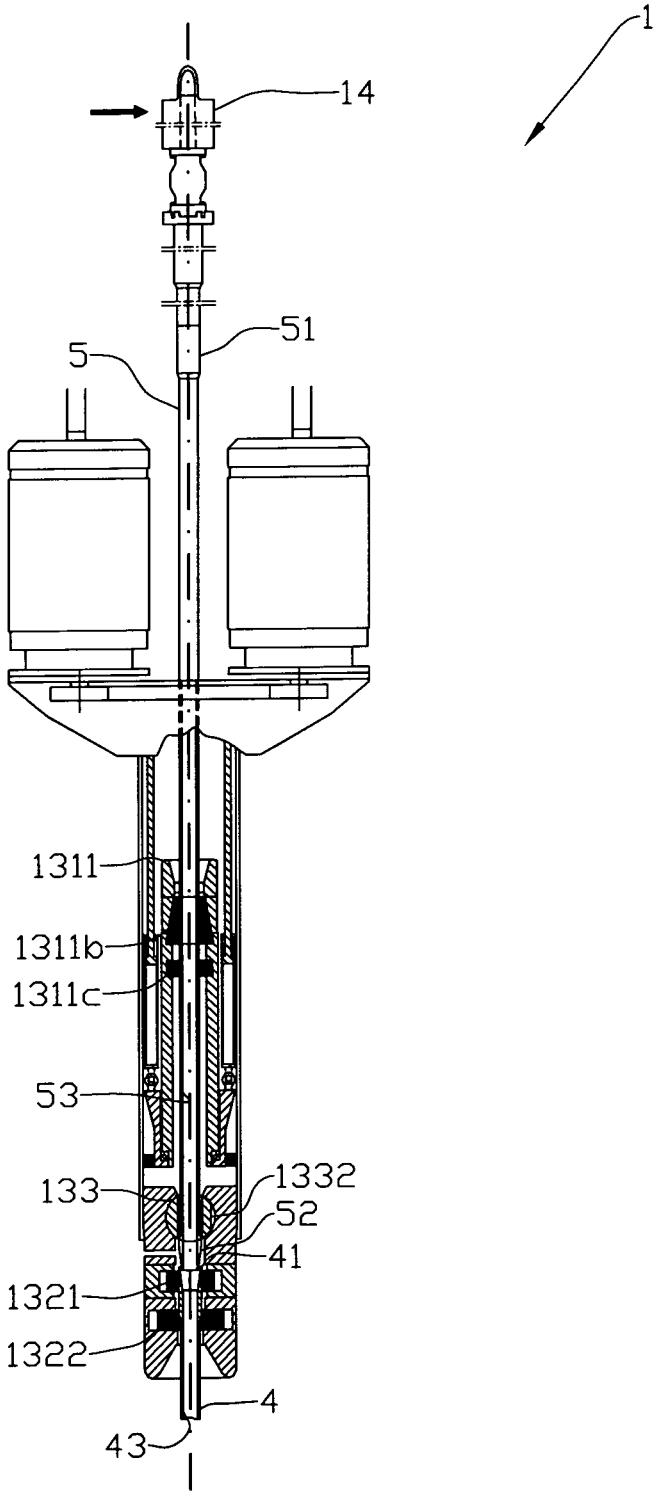

FIG. 4 corresponds to that shown in FIG. 3, but the drive shaft has been pulled out and connected to a drill pipe which is to be fitted into the drill string, and the valve and second pressure seal are activated and the drilling mud supply is running through the lateral inlet;

FIG. 5 shows the drill pipe having partially been inserted into the drilling machine and resting on the valve, the valve being closed and the second pressure seal having been activated and the drilling mud supply running through the lateral inlet;

FIG. 6 shows the pipe section partially inserted into the drilling machine and lifted clear of the closed valve, the first and second pressure seals being activated and the drilling mud supply running through the lateral inlet and though the drive shaft; and FIG. 7 shows the pipe section passed through the opened valve for connection to the drill string, the first and second pressure seals being activated and the drilling mud supply running through the drive shaft.

In FIG. 3 substantially all components are identified by their reference numerals, whereas in FIGS. 4-7, for reasons of exposition, only the components essential for understanding the principles, according to which the drilling machine of the invention is working, are indicated by reference numerals.

Figure 1:
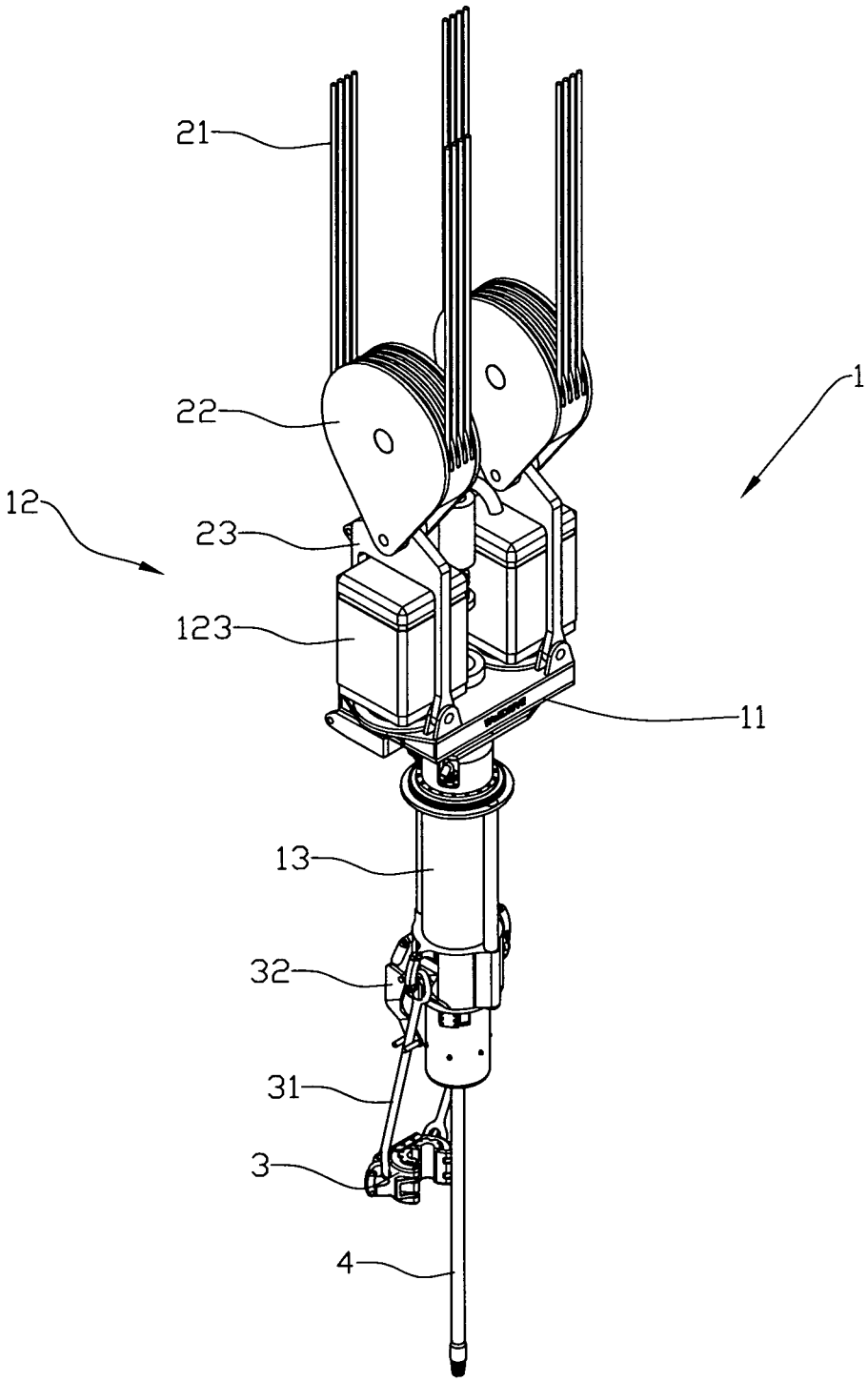
FIG. 1 shows in perspective a top drive drilling machine according to the invention.
Figure 2:
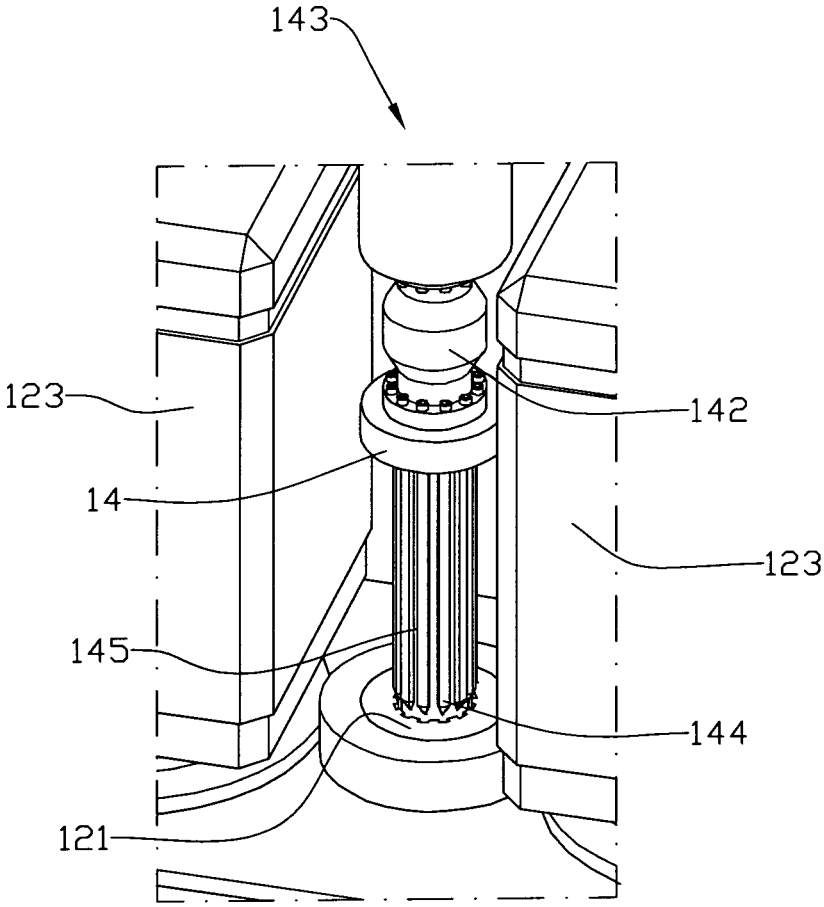
FIG. 2 shows, on a larger scale, a perspective section of the drilling machine, the drive shaft being about to be engaged in the drive.

A top drive drilling machine 1 is arranged for connection to a hoisting device of a kind known per se, arranged above a drill floor (not shown), including for example several wires 21 and pulley blocks 22 and connected to the drilling machine 1 by means of several lifting yokes 23. The drilling machine 1 is provided with a maneuverable so-called elevator 3 (for reasons of exposition, shown only in FIG. 1) of a kind known per se, for releasably holding a drill string 4 and connected to the drilling machine 1 hanging from elevator bails 31 which can swing the elevator 3 in a direction towards and away from the drill string 4 by means of an elevator manipulator 32.

The drilling machine 1 is provided with a framework 11, a drive 12 for the rotation of the drill string 4, and a connection housing 13. The drilling machine 1 is connected via flexible fluid lines 61, 62 to a drilling mud plant 6 known per se (shown schematically and for reasons of exposition only in FIG. 3), including a drilling mud reservoir, one or more pumps, pressure and flow rate control devices, necessary pipes and hoses etc. For the drilling mud plant 6 valves 63 are arranged for controlled directing the drilling mud flow into one or more optional drilling mud inlets on the drilling machine 1. The drilling mud inlets will be described in further detail in what follows.

A disconnectable drive shaft 14 is provided with a centre bore 141 extending through it and is connected, in a fluid-communicating manner, to a swivel 142 which is provided with associated rotary bearings and seals (not shown) to allow the rotation of the stem 143 of the drive shaft 14, whereas an inlet portion 144 including a first drilling mud inlet 1441 remains stationary. At an end adjacent to the swivel 142 the stem 143 of the drive shaft 14 is provided with a toothed connection portion 145 which is arranged to engage, in a releasable manner, a drive bushing 121 which is supported in the framework 11 and connected via driving wheels 122 to two motors 123. The drive bushing 121 is provided with a centric recess which is complementary to the connection portion 145. The end of the drive shaft 14 opposite the swivel 142 is provided with a threaded portion 146 arranged for releasable connection to the first end portion 51 of a drill pipe 5. The drill pipe 5 and thereby the drill string 4 are provided with fluid bore 53 and 43, respectively, in a manner known per se.

The drive shaft 14 is further provided with a hoist attachment 147 for connection to an appropriate hoisting device, for example the lifting hook of a crane (not shown).

The drilling mud inlet 1441 of the drive shaft 14 is connected in a fluid-communicating manner with the drilling mud plant 6 via a first flexible fluid line 61 and a first valve 63.

The connection housing 13 is cylindrically shaped and provided with a first chamber 131 and a second chamber 132 which are fluid-sealingly separated from each other by means of a valve formed as a ball valve 133 arranged in a partition wall 135. The ball valve 133 is provided with a centre bore 1331 which coincides with the centre line of the connection housing 13. A seat 1332 arranged for supportingly receiving the second end portion 52 of the drill pipe 5 is arranged perpendicularly to the centre bore 1331 and the rotary axis of the valve 133.

The first chamber 131 includes a snubbing unit 1311, that is, an actuator-operated thrust device arranged to force the drill pipe 5 against a well pressure, to which the drill pipe is exposed through the open end 41 of the drill string 4 in connection with the joining of the drill pipe 5 and drill string 4. The snubbing unit 1311 is provided with a mandrel 1311*a* formed with a centre bore. Several actuator-operated slips 1311*b* surround a portion of the centre bore and are arranged to grip the drill pipe 5. Further, the mandrel 1311*a* includes an actuator-operated first pressure seal 1311*c* which is arranged to fit pressure-sealingly around the drill pipe 5 or stem 143 of the drive shaft 14.

The snubbing mandrel 1311*a* is rotatably supported in a snubbing frame 1311*d*. The snubbing frame 1311*d* is connected to several actuators 1311*e*, preferably double-acting hydraulic cylinders which are arranged to move the snubbing unit 1311 in the axial direction of the drill pipe 5. The connection between the snubbing frame 1311*d* and actuators 1311*e* is articulations 1311*f* with oblong grooves allowing a certain axial movement between the snubbing frame 1311*d* and actuators 1311*e*.

The snubbing frame 1311*d* is provided with a sealing element 1311*g* fitting pressure-sealingly against the internal wall surface 134 of the connection housing 13. A supporting element 1311*h* of the snubbing mandrel 1311*a* also forms a pressure-tight connection with the snubbing frame 1311*d*. Thereby, the part of the first chamber 131 facing the valve 133 is pressure-sealingly bounded in relation to the part of the first chamber 131 facing the drive 12.

Opposite the valve 133, the second chamber 132 is provided with a drive shaft opening 136 concentric with the centre axis of the connection housing 13. A second pressure seal 1321 is arranged concentrically in the centre bore and is arranged to fit, by actuator operation, pressure-sealingly around a portion of the drill string 4. In the centre bore, between the drive shaft opening 136 and the second pressure seal 1321, is arranged an actuator-operated clamping device 1322 which is arranged to grip the drill string and bear supportingly on a collar 41 at the protruding end portion of the drill string 4.

A second drilling mud inlet 1323 is arranged in the connection housing 13 and is fluid-communicatingly connected to the second chamber 132. The second drilling mud inlet 1323 is fluid-communicatingly connected to the drilling mud plant 6 (see FIG. 3) via a second flexible fluid line 62.

For the drilling machine 1 there is arranged a rotatable power tong (not shown) according to a technique known per se, for the make-up and break-out of the drill string 5. The power tong may be integrated in the drilling machine but is not part of the invention.

In the drawings 4-7, for reasons of exposition, the drilling mud plant 6 is not shown but pressurized drilling mud inlets 1323, 1441 are indicated by an arrow.

In ordinary operation the drive shaft 14 is connected to the drive 12, drill string 4 and drilling mud plant 6, the drive 12 rotating the drive shaft 14 and drill string 4, and drilling mud is supplied to the drill string 4 through the drive shaft 14. The first and second pressure seals 1311*c*, 1321 are open, and the valve 133 is open. The drilling machine 1 is lowered in accordance with the progress of the drilling.

When a new drill pipe 5 needs to be fitted in the drill string 4, the pressure seals 1311*c*, 1321 are closed. The circulation of drilling mud continues through the drive shaft 14, and the second drilling mud inlet 1323 is placed under pressure. The drive shaft 14 is disconnected from the drill string 4 and pulled up through the valve 133 which is then closed. Thereby, the second chamber 132 is pressure-tight opposite the first chamber 131 and the drilling mud circulation through the drive shaft 14 is stopped. The first pressure seal 1311*c* is opened, and the drive shaft 14 is lifted up by the drilling machine 1. The drilling mud circulation is maintained through the second drilling mud inlet 1323.

The drive shaft 14 and the new drill pipe 5 are connected and lowered into the drilling machine 1 until the lower end of the drill pipe 5 rests on the seat 1332 of the valve 133. The slips 1311*b* of the snubbing unit 1311 grip the drill pipe 5. The first pressure seal 1311*c* is closed and the drilling mud circulation through the drive shaft 14 is restored. The lower part of the first chamber 131 is pressurized, and the drilling mud pressure provides for the snubbing frame 1311*d* to lift by an amount corresponding to the travel of the articulations 1311*f* in the oblong grooves. The pressure within the first and second chambers 131, 132 is balanced, and the drill pipe 5 is clear of the valve 133 which may then be opened. The drive shaft 14 and drill pipe 5 are lowered to the open end of the drill string by the snubbing unit 1311 being moved downwards, and the joining of the drill pipe 5 into the drill string 4 may take place in a manner known per se by the drill pipe 5 being rotated and lowered in a synchronized movement while the drill string 4 is held fixed.

As the drill pipe 5 is joined to the drill string 4, the upper end of the drill string 4 is closed, and the drilling mud supply through the second drilling mud inlet 1323 ceases and is subsequently maintained through the drive shaft 14. After the supply to the second drilling mud inlet 1323 has been closed, the pressure seals 1311*c*, 1321 can be opened and the drilling machine 1 lifted for engagement of the drive shaft 14 with the drive 12, so that the drill string may be set into rotation for further drilling.

Through the operations described above the object of the invention has been achieved, as continuous drilling mud supply to the drill string is maintained during the entire process of lengthening the drill string.

The invention claimed is:

1. A device comprising:

a top drive;

a self-contained and releasable drive shaft assembly which is arranged for both driven insertion into and retrieval from the top drive and connectable to a first end portion of a drill pipe, said drive shaft assembly is provided with a centre bore extending therethrough, said center bore is arranged for fluid communication between a drilling mud plant and a fluid bore of the drill pipe;

a connection housing including a first chamber and a second chamber, said connection housing is integrated as part of the top drive for synchronous movement with the top drive;

the first chamber being provided with a releasable, drive-shaft/pipe-surrounding first pressure seal;

the second chamber being provided with a releasable, drill-string-surrounding second pressure seal; and an interface between the first and second chambers being made up of a valve which is arranged to provide, in an open position, a passage for the drill pipe or drive shaft; and a drilling mud inlet arranged for the second chamber and arranged for fluid communication between the drilling mud plant and the connection housing;

wherein the drive shaft assembly and the connection housing enable continuous circulation of drilling mud during drilling operations.

2. The device in accordance with claim 1, said connection housing further comprising a snubbing unit arranged to move the drill pipe in an axial direction against a well pressure for connection to the drill string.

3. The device in accordance with claim 2, further comprising a mechanical connection between the connection housing and drill pipe is arranged by a thrust device which is provided with several actuators arranged for axial movement of the drill pipe, and at least one set of gripping means which are arranged to surround the drill pipe at least partially, at least one articulation arranged for the actuators being arranged to provide the axial movement when a fluid pressure is applied to the first chamber.

4. The device in accordance with claim 1, said valve comprising a ball valve.

5. The device in accordance with claim 1, said valve comprising a seat portion arranged to receive an end portion of the drill pipe.

6. The device in accordance with claim 5, further comprising said seat portion is formed on a valve ball surface.

7. The device in accordance with claim 1, said drive shaft comprising a bearing portion which is arranged to releasably engage a rotatable power tong.

8. The device in accordance with claim 1, further comprising a bearing portion with a polygonal cross-sectional profile.

9. A method of continuously supplying drilling mud by the use of a top drive, said method comprising the following steps:

establishing a borehole with a drill string and a circulation circuit for the drilling mud, a drive shaft of the top drive being connected to a drilling mud plant and the drill string, and the drilling mud being supplied to the borehole through a centre bore in the drive shaft arranged for fluid communication with the drill string;

activating a first pressure seal around the drive shaft in a first chamber of a connection housing that is integrated as part of the top drive for synchronous movement with the top drive, and forming a second pressure seal around the drill string in a second chamber in the connection housing;

supplying drilling mud to the second chamber through a drilling mud inlet;

stopping the drill string rotation and disconnecting the drive shaft from the drill string;

pulling the drive shaft out of the second chamber;

closing, in a pressure-sealing manner, a valve forming an interface between the first and the second chambers;

stopping the supply of drilling mud through the drive shaft;

pulling the drive shaft out of the first chamber;

connecting a drill pipe to the drive shaft;

inserting the drill pipe and drive shaft into the upper chamber;

activating the first pressure seal;

opening the valve;

stopping the supply of drilling mud through the drilling mud inlet;

connecting the drill pipe to the drill string; and resuming the drill string rotation.

* * * * *